US009578717B2

(12) United States Patent
Chen et al.

(10) Patent No.: US 9,578,717 B2
(45) Date of Patent: Feb. 21, 2017

(54) MONITORING AND CONTROL DEVICE AND METHOD FOR AN ILLUMINATION APPARATUS

(71) Applicant: INTERNATIONAL BUSINESS MACHINES CORPORATION, Armonk, NY (US)

(72) Inventors: Bolton Po-Yu Chen, New Taipei (TW); Cliff Pei-Ju Chen, Taipei (TW); Patrick Chun-Chi Chen, Taipei (TW); Michk Huang, Taipei (TW)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 14/964,606

(22) Filed: Dec. 10, 2015

(65) Prior Publication Data

US 2016/0192457 A1 Jun. 30, 2016

(30) Foreign Application Priority Data

Dec. 30, 2014 (TW) ..... 103146242

(51) Int. Cl.
*H05B 37/02* (2006.01)
*H05B 33/08* (2006.01)
*H05B 37/03* (2006.01)

(52) U.S. Cl.
CPC ..... *H05B 33/0893* (2013.01); *H05B 37/03* (2013.01)

(58) Field of Classification Search
CPC ..... H05B 37/02; H05B 33/08
USPC ..... 315/159, 160, 175, 158, 291
See application file for complete search history.

(56) References Cited

U.S. PATENT DOCUMENTS

| | | | | |
|---|---|---|---|---|
| 5,397,963 | A * | 3/1995 | Manson | H05B 37/038 315/119 |
| 7,050,808 | B2 | 5/2006 | Janusz et al. | |
| 8,260,575 | B2 | 9/2012 | Walters et al. | |
| 2010/0208501 | A1* | 8/2010 | Matan | H02J 3/18 363/95 |
| 2011/0133655 | A1* | 6/2011 | Recker | H02J 9/02 315/159 |

(Continued)

FOREIGN PATENT DOCUMENTS

TW 201330696 A 7/2013

*Primary Examiner* — Minh D A
(74) *Attorney, Agent, or Firm* — Cantor Colburn LLP; Damion Josephs

(57) ABSTRACT

Disclosed is a monitoring and control device, applicable to an illumination apparatus. The illumination apparatus includes a lighting unit which outputs a signal representative of a status of the lighting unit. The illumination apparatus includes an apparatus identifier. The illumination apparatus includes: a monitoring circuit electrically coupled to the lighting unit, for receiving the signal and determining whether the illumination apparatus needs to be replaced in response to the signal satisfying a condition; a controller electrically coupled to the monitoring circuit; and a receiving/transmitting unit electrically coupled to the controller, wherein the controller controls the receiving/transmitting unit to transmit the apparatus identifier of the illumination apparatus to be replaced in response to the determination is affirmative. A method thereof is also disclosed.

16 Claims, 5 Drawing Sheets

(56) References Cited

U.S. PATENT DOCUMENTS

2012/0038281 A1* 2/2012 Verfuerth ..... H05B 37/0272
315/152

* cited by examiner

MONITORING AND CONTROL DEVICE AND METHOD FOR AN ILLUMINATION APPARATUS

FOREIGN PRIORITY

This application claims priority to Taiwan Patent Application No. 103146242, filed Dec. 30, 2014, and all the benefits accruing therefrom under 35 U.S.C. §119, the contents of which in its entirety are herein incorporated by reference.

BACKGROUND

The present invention generally relates to illumination and in particular, relates to a monitoring and control device and method for an illumination apparatus and the illumination apparatus and an illumination system thereof.

Illumination apparatuses are indispensable in people's living, and have played significant roles in the development of cities for a long time. Whether in the cities or the countries, illumination apparatuses are everywhere to be seen, such as at homes, offices, streets, public spaces, etc.

When an illumination apparatus is damaged or has lumen depreciation, manual inspection is generally required for replacement or maintenance. However, manual inspection is extremely time-consuming and inefficient, and also has the shortcomings of delayed inspection/response. For illumination apparatuses installed on streets, if damages are not timely inspected/responded, issues in traffic and pedestrian safety may occur.

In conventional technologies, a signal path may be configured at the same time when configuring power lines of the power plant, and the damaged illumination apparatus may be detected according to the power status and an alert may be sent using the signal path; however, such a scheme has a rather high cost. In another conventional technology, each street lamp has a GSM transceiver system or a SIM card to communicate with a control system, which requires additional equipment and telecommunication company charges, and the costs in both software and hardware are increased. In still another conventional technology, the above two schemes may be combined, yet the issue of higher costs in software and hardware remains.

SUMMARY

In one aspect, the present invention provides an illumination system, an illumination apparatus, a monitoring and control device, and a method thereof that have highly efficient identification and low costs in software and hardware. Timely replacements are facilitated when illumination apparatuses have failures, depreciations, or damages, and the invention is suitable for large extents and large areas.

In one aspect, an embodiment of the present invention provides a monitoring and control device, applicable to an illumination apparatus comprising a lighting unit which outputs a signal representative of a status of the lighting unit. The illumination apparatus comprises an apparatus identifier. The monitoring and control device comprising: a monitoring circuit electrically coupled to the lighting unit and adapted for receiving the signal and determining whether the illumination apparatus needs to be replaced in response to the signal satisfying a condition; a controller electrically coupled to the monitoring circuit; and a receiving/transmitting unit electrically coupled to the controller. The controller controls the receiving/transmitting unit to transmit the apparatus identifier of the illumination apparatus to be replaced in response to the illumination apparatus being determined to be replaced.

In one aspect, an embodiment of the present invention provides a monitoring and control method, applicable to an illumination apparatus comprising a monitoring circuit, a controller, a receiving/transmitting unit and a lighting unit which outputs a signal representative of a status of the lighting unit. The illumination apparatus comprises an apparatus identifier. The monitoring and control method comprising: the monitoring circuit receiving the signal and determining whether the illumination apparatus needs to be replaced in response to the signal satisfying a condition; and the controller controlling the receiving/transmitting unit to transmit the apparatus identifier of the illumination apparatus to be replaced in response to the illumination apparatus being determined to be replaced.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings.

DETAILED DESCRIPTION

Citation of "a specific embodiment" or a similar expression in the specification means that specific features, structures, or characteristics described in the specific embodiments are included in at least one specific embodiment of the present invention. Hence, the wording "in a specific embodiment" or a similar expression in this specification does not necessarily refer to the same specific embodiment.

Hereinafter, the present invention and various embodiments of the present invention will be described in more detail with reference to the accompanying drawings. Nevertheless, it should be understood that the present invention could be modified by those skilled in the art in accordance with the following description to achieve the excellent results of the present invention. Therefore, the following description shall be considered as a pervasive and explanatory disclosure related to the present invention for those skilled in the art, not intended to limit the claims of the present invention.

Citation of "an embodiment", "a certain embodiment" or a similar expression in the specification means that related features, structures, or characteristics described in the embodiment are included in at least one embodiment of the present invention. Hence, the wording "in a embodiment", "in a certain embodiment" or a similar expression in this specification does not necessarily refer to the same specific embodiment.

Figure 1:
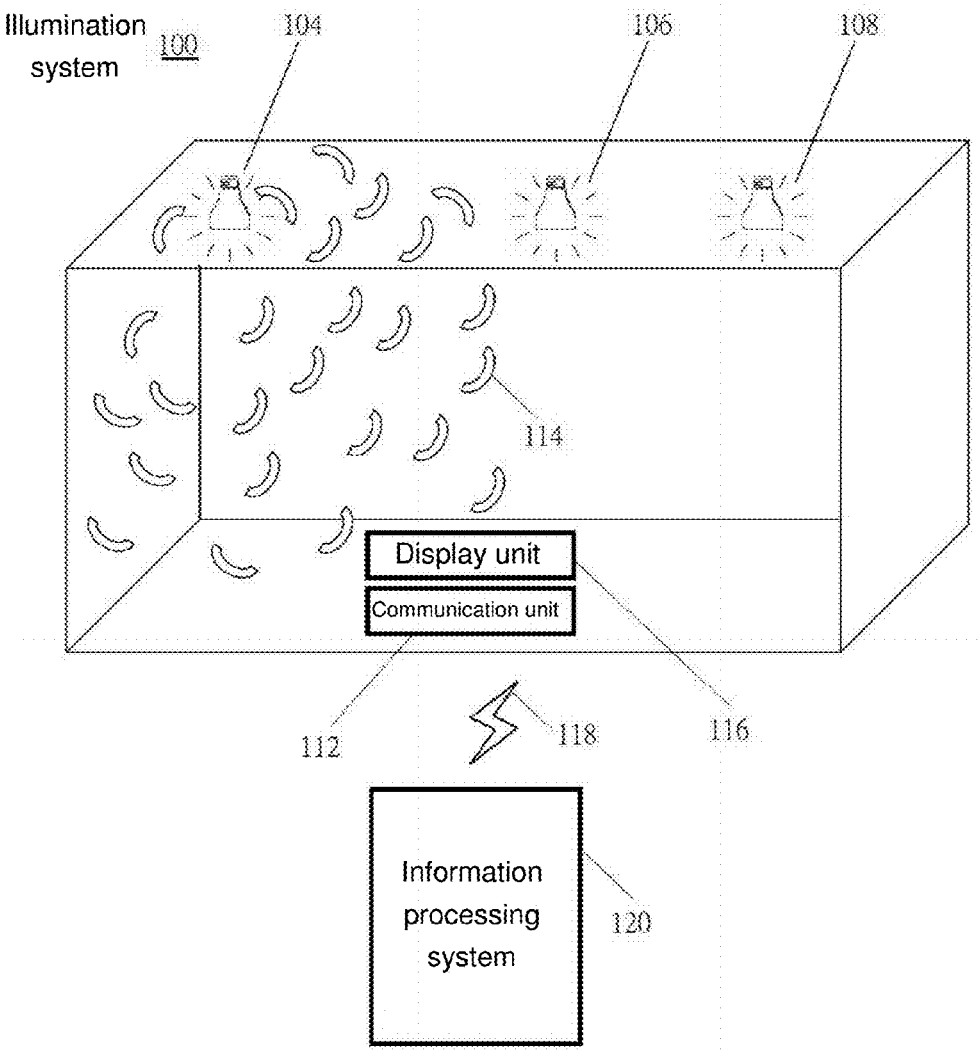
FIG. 1 schematically shows an illumination system of an embodiment of the present invention.
Figure 2:
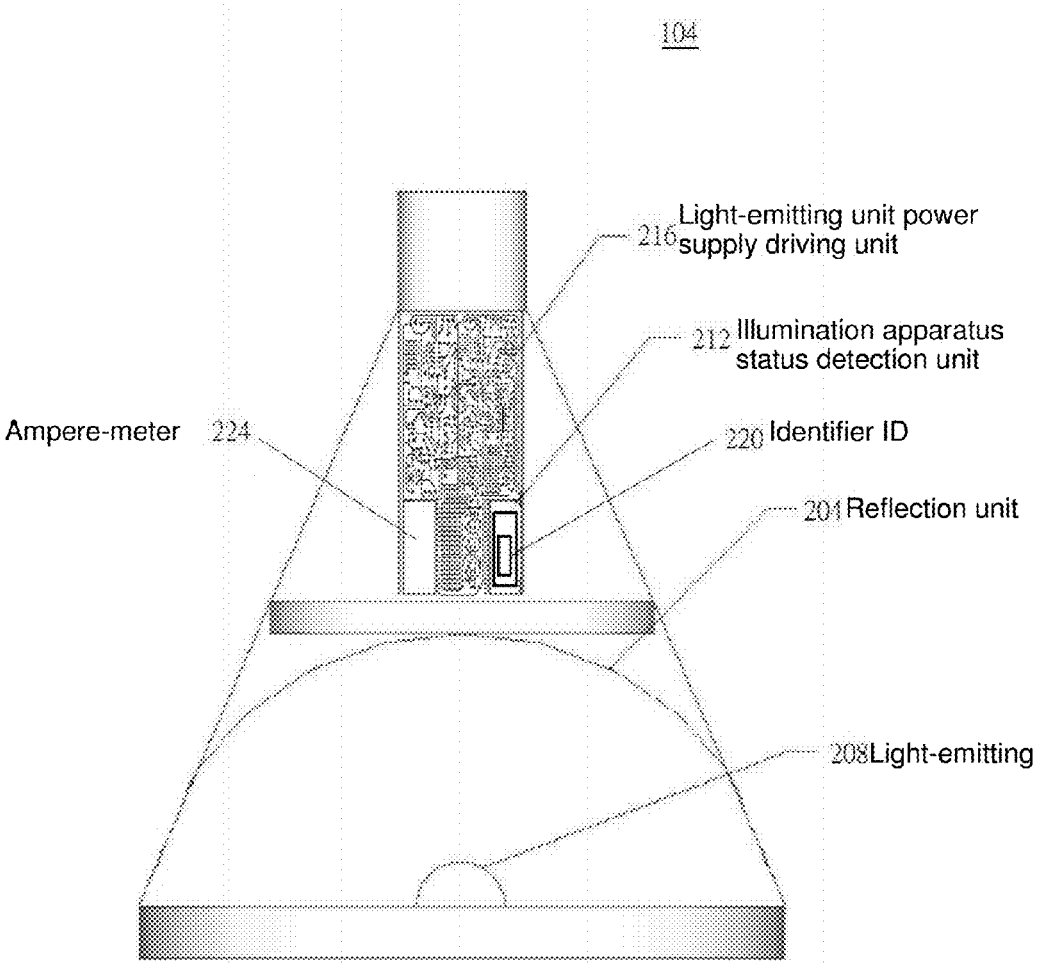
FIG. 2 schematically shows an illumination apparatus of an embodiment of the present invention.

FIG. 1 shows an illumination system of an embodiment of the present invention, which includes illumination apparatuses and the illumination system thereof, and may provide a mechanism/system for control/alert. When a light bulb has a failure or damage, the user or manager may be timely notified in a highly efficient scheme for replacements. FIG. 2 shows a function block diagram of the illumination apparatus of FIG. 1.

Referring to FIG. 1, the illumination system 100 includes illumination apparatuses 104, 106, and 108, which may be light-emitting diode (LED) lamps, light bulbs, fluorescent lamps, table lamps, ceiling lamps, street lamps, indicating lamps, or other light-emitting devices. Although FIG. 1 shows three LED lamps, there may be any number of lamps and the invention is not limited thereto. The illumination system 100 also includes a communication unit 112 and a display unit 116. The communication unit 112 may be, for example, a radio-frequency (RF) transceiver module or other equivalent devices to receive a signal 114 transmitted from the illumination apparatuses 104, 106, and 108. The illumination apparatus 104 includes an illumination apparatus status detection unit 212 (shown in FIG. 2 and described later), and the illumination apparatus status detection unit 212 includes a RF transceiver 304 (shown in FIG. 3 and described later) that may transmit the signal 114 of the illumination apparatuses 104, 106, and 108 to the corresponding communication unit 112, and the communication unit 112 may also transmit signals to the RF transceiver 304 to achieve bidirectional communication purposes. The display unit 116 provides a typical monitoring function, such as a display, but the invention is not limited thereto. In one embodiment, the communication unit 112 and the display unit 116 may be further modularized together. FIG. 1 also shows an information processing system 120, which may communicate with the communication unit 112 by a signal 118 (such as a RF signal, but the invention is not limited thereto).

In one embodiment, the illumination apparatuses 104, 106, and 108 are LED lamps; as shown in FIG. 2, the LED lamp 104 includes a reflection unit 204, a light-emitting unit 208, an illumination apparatus status detection unit 212, a light-emitting unit power supply driving unit 216, and an ampere-meter 224. The reflection unit 204 may be a typical reflector. The light-emitting unit 208 may be a typical packaged LED having an housing and multiple LED chips. The light-emitting unit power supply driving unit 216 is electrically connected to the light-emitting unit 208, and may be a power supply driving circuit implemented on a printed circuit board assembly (PCBA) or other electronic devices that may be used to drive the light-emitting unit 208 to emit light. In one embodiment, the light-emitting unit power supply driving unit 216 is implemented on a printed circuit board assembly which integrates a logic integrated circuit (IC) 316 (shown in FIG. 3) and other related circuits. The illumination apparatus status detection unit 212 may be a circuit detecting whether the illumination apparatus 104 is damaged or has depreciation reaching inadequacy, and the details and operations thereof shall be described later. In one embodiment, the illumination apparatus status detection unit 212 may have an identifier ID 220, and the exclusive identifier ID 220 of the illumination apparatus status detection unit 212 of a certain illumination apparatus may be transmitted to the communication unit 112 by the RF transceiver 304 (FIG. 3) of the illumination apparatus status detection unit 212. In another embodiment, the identifier ID 220 may also be embedded in other electronic circuit devices of the illumination apparatus status detection unit 212, and the invention is not limited to that shown in the figure. Each of the illumination apparatuses 104, 106, and 108 of the illumination system 100 correspond to different identifier IDs, respectively, for identifying each of the illumination apparatuses 104, 106, and 108. In other words, the illumination apparatus status detection unit 212 and the communication unit 112 collectively operate to transmit and communicate the corresponding identifier ID of a certain illumination apparatus. In other embodiments, the identifier ID 220 may be implemented on other components of the illumination apparatus 104 in suitable configurations.

In fact, the identifier ID 220 may be a unique identifier related to the illumination apparatuses 104, 106, 108, or other illumination apparatuses of the illumination system 100. In one embodiment, the identifier ID 220 may be any combination of numerals, alphabets, and special characters.

In one embodiment, the ampere-meter 224 of the illumination apparatus 104 may be a typical ampere-meter implemented in the light-emitting unit power supply driving unit 216 which is mainly used for measuring the current passing through the illumination apparatus 104 or the light-emitting unit 208 or other physical quantities, and for providing current-related or other information. The ampere-meter 224 may be implemented on the printed circuit board assembly of the light-emitting unit power supply driving unit 216. In other embodiments, the ampere-meter 224 may be implemented on other components of the illumination apparatus 104 in suitable configurations.

The identifier ID 220 may be stored in a non-volatile memory (not shown) of the light-emitting unit power supply driving unit 216, which may be a flash read-only memory (ROM), a non-volatile electrically-erasable programmable read-only memory (EEPROM), etc., but the invention is not limited thereto. The non-volatile memory includes a protected area and a flashable area. The protected area stores non-erasable codes, such as, but not limited to, the identifier ID 220, additional function information, etc. The flashable area may store other erasable information. The above technology is already well known to those skilled in the related art. In addition, the identifier ID 220 may be implemented on other components of the illumination apparatus 104 in suitable configurations.

Figure 3:
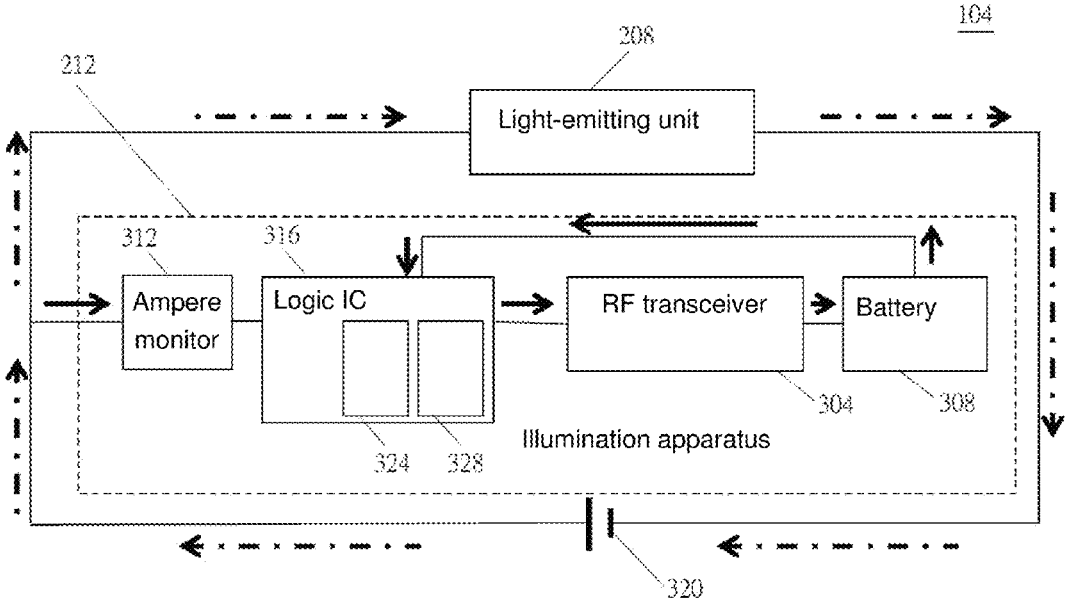
FIG. 3 schematically shows a circuit diagram of an illumination apparatus status detection unit of an embodiment of the present invention.

FIG. 3 shows a circuit diagram of the illumination apparatus status detection unit 212 of an embodiment of the present invention. The illumination apparatus status detection unit 212 includes a RF transceiver 304, a battery 308, an ampere monitor 312, a logic IC 316, and a ground 320. The ampere monitor 312 is electrically coupled to the ampere-meter 224 and the logic IC 316, the logic IC 316 is electrically coupled to the RF transceiver 304 and the battery 308, and the RF transceiver 304 is electrically coupled to the battery 308. Referring to FIG. 3, the circuit of the light-emitting unit 208 and the ground 320 is also shown in addition to the above circuit. The logic IC 316 includes components of a controller 324, a switch 328, and a fuse (not shown). The logic IC 316 is implemented to control operations of the RF transceiver 304 such as transmitting the identifier ID 220 in response to a current level, voltage level, or power level outputted by the ampere-meter 224. The switch 328 is a typical electronic device that opens a circuit, stops a current, or redirects a current to other circuits. On the other hand, the fuse is mainly for protection by preventing overvoltage, such as during lightening when light bulbs are used, for example. The battery 308 is mainly for supplying power when the illumination apparatus 104 is damaged to transmit the aforementioned signals. The battery 308, the switch 328, and the fuse are well known to those skilled in the related art and the details are not described here.

Referring to FIG. 3, the ampere monitor 312 may be implemented as a control logic IC. The ampere-meter 224 has an initial output value and a signal of the ampere-meter 224 passes through the ampere monitor 312. The switch 314 is conducting when the ampere monitor 312 detects that the signal of the ampere-meter 224 satisfies a certain condition. The certain condition may be that the output power of the ampere-meter 224 is zero, such as, but not limited to, when the illumination apparatus 104 is damaged and requires to be replaced. The certain condition may also be that the output of the ampere-meter 224 is lower than a certain proportion (such as 50%, but the invention is not limited thereto) of the initial output value of the ampere-meter 224, which indicates that the illumination apparatus 104 has depreciation reaching inadequacy and requires to be replaced. The certain condition may also be other situations in which the illumination apparatus 104 requires to be replaced. In the above situations, the illumination apparatus status detection unit 212 may be operated, yet it should be noted the operations of the illumination apparatus status detection unit 212 are not limited thereto.

In one embodiment, the ampere monitor 312 detects the output current level of the ampere-meter 224, and when the detected current level is lower than a certain level (or when the detected current level is lower than or equal to a certain level), a corresponding signal is triggered to operate the controller 324. In actual practices, the ampere monitor 312 detects the current passing though the illumination apparatus 104 or the light-emitting unit 208 in amperes which represents the power of light emission. In an example using LED lamps, if the replacement provision of LED lamps is that a failure rate of LED chips above 50% requires replacement, when the passing current in amperes is 50% than that of the rated current, the LED lamp may be considered to be at the threshold of damaging and replacement should be prepared. When the passing current in amperes lower than 50% than that of the rated current (i.e., the failure rate of LED chips in the LED lamp is above 50%), the LED lamp may be considered requiring replacement. However, the above embodiments should be understood as only illustrative and not restrictive in every aspect. In fact, the certain proportion by which the passing current is lower than the rated current in amperes (or the certain proportion by which the passing current is lower than or equal to the rated current in amperes) to trigger the replacement event of the illumination apparatus 104 may be determined according to actual environments and requirements, such as between 10% and 50%, but the invention is not limited thereto.

In another embodiment, when the output power of the ampere-meter 224 is zero, the illumination apparatus 104 is damaged and requires to be replaced. According to the present invention, the corresponding signal is triggered to operate the controller 324.

As described in above, the ampere monitor 312 may detect the proportion of the output of the ampere-meter 224 to the initial output value of the ampere-meter 224, or detect whether the output of the ampere-meter 224 is zero, so that the ampere monitor 312 may trigger the controller 324 to transmit a control signal to control the switch 314 to operate and conduct, and the RF transceiver 304 subsequently transmits a signal, such as, but not limited to, the identifier ID 220 of the illumination apparatus status detection unit 212. In response to the signal of the ampere-meter 224, the ampere monitor 312 triggers the transmission of the control signal by the above mechanism, and the damage and aging of the illumination apparatus 104 may be transmitted to the communication unit 112 by a method that is highly efficient and has low cost; the steps and details thereof shall be further described later.

Referring to FIG. 1 to FIG. 3, in one embodiment, a plurality of illumination systems 100 is used to serve a larger area, such as, but not limited to, a building area (not shown). The building area includes a plurality of illumination systems 100, and each illumination system 100 includes a plurality of illumination apparatuses, which is shown here as the illumination apparatuses 104, 106, and 108 as an example. The plurality of illumination systems 100 are controlled to manage the plurality of illumination apparatuses of the building area. As described in above, when the illumination apparatus is damaged or has lumen depreciation, the RF transceiver 304 of the illumination apparatus being damaged or having lumen depreciation is automatically operated to transmit a corresponding signal of the illumination apparatus being damaged or having lumen depreciation to the communication unit 112 or to an adjacent illumination apparatus to be recursively transmitted to subsequent illumination apparatuses until the signal is transmitted to the closest or corresponding communication unit 112, and is subsequently transmitted to the information processing system 120 for subsequent overall control and management of the system, such as management by a central control information processing system (not shown; such as a central management server, but the invention is not limited thereto). In other embodiments, the area may be an illumination area of a street, an illumination area of a market, an illumination area of a park, etc.; however, the above embodiments should be understood as only illustrative and not restrictive in every aspect.

Figure 4:
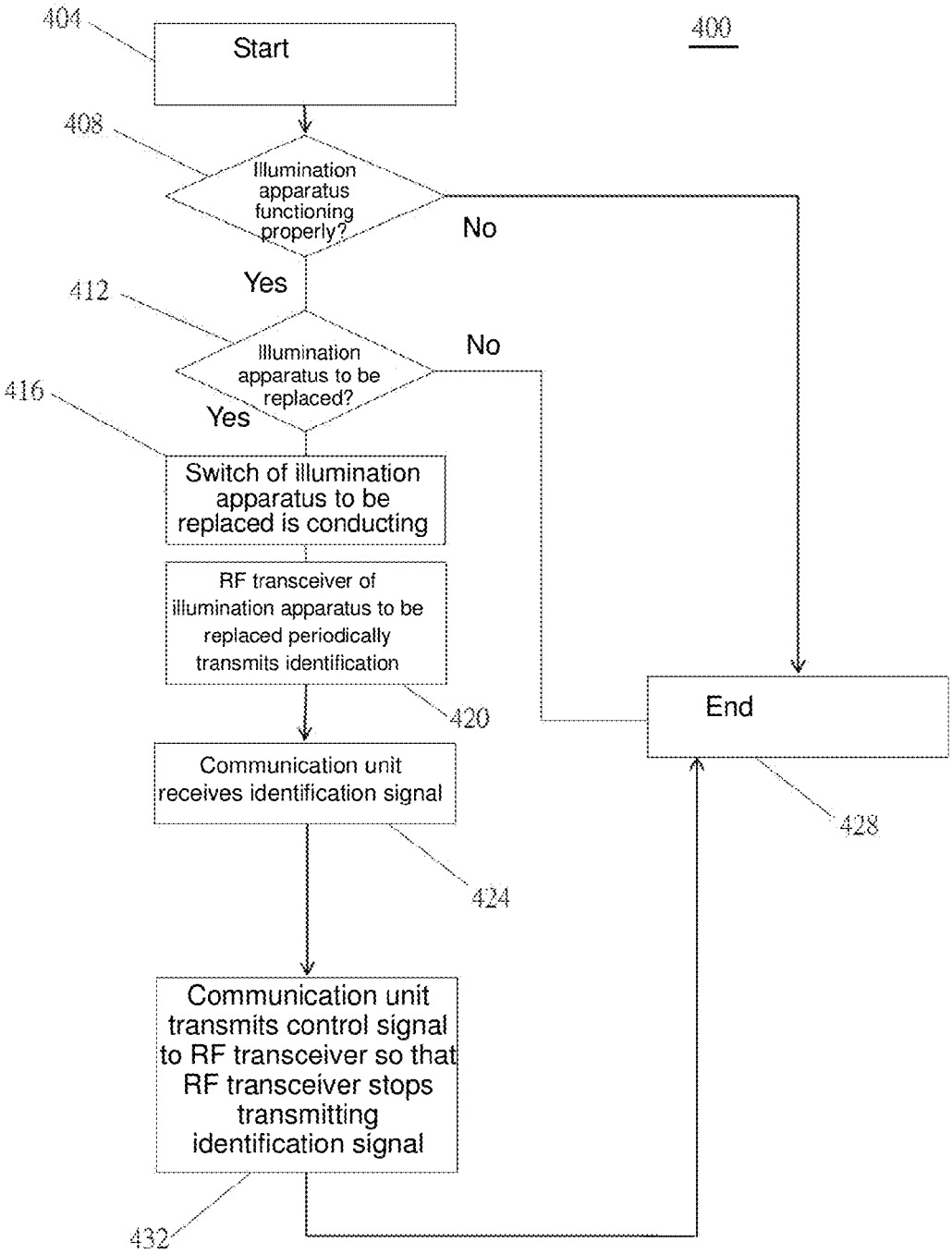
FIG. 4 schematically shows a control method of illumination of an embodiment of the present invention.

FIG. 4 shows a flow chart of an exemplifying embodiment of the present invention, which describes an illumination control method 400 of the present invention in accordance with the examples in FIG. 1 to FIG. 3. As shown at block 404, the method 400 starts. Next, as shown at block 408, the method 400 includes determining whether the illumination apparatus 104 functions properly; if not (such as, but not limited to, due to power failure), the flow proceeds to block 428; if yes, the flow proceeds to block 412.

As shown at block 412, the method 400 includes determining whether the illumination apparatus 104 needs to be replaced; if not, the method 400 proceeds to block 428; if yes, the method 400 proceeds to block 416. In one embodiment, the illumination apparatus 104 is conducting and current passes through the illumination apparatus 104, which may be measured by the ampere-meter 224, and the ampere-meter 224 has an initial output value. The signal of the ampere-meter 224 passes through the ampere monitor 312. When the ampere monitor 312 detects that the signal of the ampere-meter 224 satisfies a certain condition, the illumination apparatus 104 is determined to be replaced. In one embodiment, the certain condition may be that the output power of the ampere-meter 224 is zero, such as, but not limited to, when the illumination apparatus 104 is damaged and requires to be replaced. In another embodiment, the certain condition may be that the output of the ampere-meter 224 is lower than a certain proportion (such as 50%, but the invention is not limited thereto) of the initial output value of the ampere-meter 224, which indicates that the illumination apparatus 104 has depreciation reaching inadequacy and requires to be replaced.

Next, as shown at block 416, the method 400 includes conducting the switch 314 of the illumination apparatus 104 to be replaced. In one embodiment, the switch 314 is conducting when the output power of the ampere-meter 224 is zero. In another embodiment, the switch 314 is conducting when the output of the ampere-meter 224 is lower than a certain proportion (such as 50%, but the invention is not limited thereto) of the initial output value of the ampere-meter 224.

Next, as shown at block 420, the method 400 includes periodically transmitting an identification signal by the RF transceiver 304 of the illumination apparatus 104 to be replaced. In one embodiment, the identification signal may be the identifier ID 220 of the illumination apparatus 104 to be replaced.

Next, as shown at block 424, the method 400 includes the communication unit 112 receiving the identification signal. In one embodiment, the communication unit 112 receives the identifier ID 220 of the illumination apparatus 104 to be replaced.

Next, as shown at block 432, the method 400 includes the communication unit 112 transmitting a control signal to the RF transceiver 304 so that the RF transceiver 304 stops transmitting the identification signal (the identifier ID 220 of the illumination apparatus 104 to be replaced) in response to the communication unit 112 receiving the identifier ID 220. Next, as shown at block 428, the method 400 ends. Subsequently, the maintenance personnel may locate the illumination apparatus 104 to be replaced by the transmitted signal in above and carry out subsequent processes.

Figure 5:
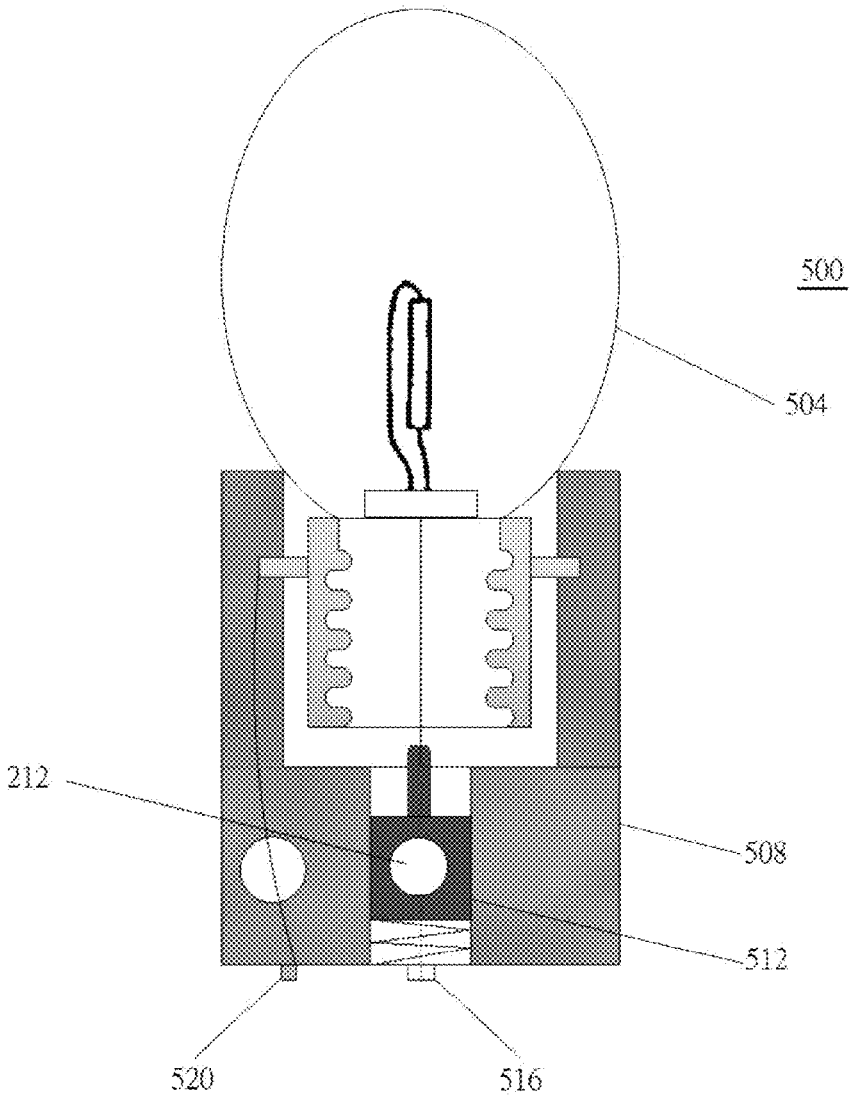
FIG. 5 schematically shows an illumination apparatus of an embodiment of the present invention.

FIG. 5 shows a light bulb 500 of an embodiment of the present invention. The light bulb 500 includes a glass bulb 504, a cap 508, a screw thread base 512, and contacts 516 and 520. The illumination apparatus status detection unit 212 may be configured in the screw thread base 512 or other components of the light bulb 500, but the invention is not limited thereto. The light bulbs are well known to those skilled in the related art and the details are not described here.

The present invention may be implemented in illumination systems of any extent and any area, especially to timely manage large extents of illumination apparatuses or wide areas. In various embodiments, the illumination system may be domestic or building illumination systems, factory illumination systems, park illumination systems, street lamp systems, etc., and the invention is not limited thereto. It should be noted that, for applications in large extents and wide areas, the usage of RF transceivers reduces the costs in software and hardware and provides highly efficient identification of illumination apparatuses.

The foregoing detailed description of the embodiments is used to further clearly describe the features and spirit of the present invention. The foregoing description for each embodiment is not intended to limit the scope of the present invention. All kinds of modifications made to the foregoing embodiments and equivalent arrangements should fall within the protected scope of the present invention. Hence, the scope of the present invention should be explained most widely according to the claims described thereafter in connection with the detailed description, and should cover all the possibly equivalent variations and equivalent arrangements.

The invention claimed is:

1. A monitoring and control device, applicable to an illumination apparatus comprising a lighting unit which outputs a signal representative of a status of the lighting unit, the illumination apparatus comprising an apparatus identifier, the monitoring and control device comprising:

a monitoring circuit, electrically coupled to the lighting unit and adapted for receiving the signal and determining whether the illumination apparatus needs to be replaced in response to the signal satisfying a condition;

a controller, electrically coupled to the monitoring circuit; and a receiving/transmitting unit, electrically coupled to the controller, wherein the controller controls the receiving/transmitting unit to transmit the apparatus identifier of the illumination apparatus to be replaced in response to the illumination apparatus being determined to be replaced, wherein the receiving/transmitting unit comprises a radio-frequency (RF) transceiver, and the illumination apparatus comprises a LED lamp, a light bulb, a fluorescent lamp, a street lamp, or an indicating lamp and further comprising a switch electrically coupled to the controller and the receiving/transmitting unit, wherein the lighting unit comprises an ampere-meter outputting the signal representative of the status of the lighting unit, wherein the monitoring circuit comprises an ampere monitor.

2. The monitoring and control device as claimed in claim 1, wherein the receiving/transmitting unit periodically transmits the apparatus identifier.

3. The monitoring and control device as claimed in claim 1, wherein the illumination apparatus is adapted for communicating with a communication unit, wherein the communication unit transmits a control signal to the receiving/transmitting unit so that the receiving/transmitting unit stops transmitting the apparatus identifier in response to the communication unit receiving the apparatus identifier.

4. The monitoring and control device as claimed in claim 3, wherein the communication unit transmits the apparatus identifier to an information system in response to the communication unit receiving the apparatus identifier, wherein the information system comprises an information processing system managing the illumination apparatus, an information processing system managing other illumination apparatuses, or a central control information processing system.

5. The monitoring and control device as claimed in claim 1, wherein the condition comprises: an output of the ampere-meter is determined to be zero by the ampere monitor, wherein the controller controls the switch to turn on so that the receiving/transmitting unit transmits the apparatus identifier in response to the output of the ampere-meter being zero.

6. The monitoring and control device as claimed in claim 1, wherein the condition comprises: an output of the ampere-meter is determined to be lower than and/or equal to a certain proportion of an initial output value of the ampere-meter by the ampere monitor, wherein the controller controls the switch to turn on so that the receiving/transmitting unit transmits the apparatus identifier.

7. The monitoring and control device as claimed in claim 6, wherein the certain proportion is between 10% and 50%.

8. The monitoring and control device as claimed in claim 1, further comprising a battery, electrically coupled to the receiving/transmitting unit, supplying power to the receiving/transmitting unit when the illumination apparatus is damaged.

9. An illumination apparatus, comprising:

a lighting unit;

a ground; and a monitoring and control device comprising:

a monitoring circuit, electrically coupled to the lighting unit and adapted for receiving the signal and determining whether the illumination apparatus needs to be replaced in response to the signal satisfying a condition;

a controller, electrically coupled to the monitoring circuit; and a receiving/transmitting unit, electrically coupled to the controller, wherein the controller controls the receiving/transmitting unit to transmit the apparatus identifier of the illumination apparatus to be replaced in response to the illumination apparatus being determined to be replaced, wherein the receiving/transmitting unit comprises a radio-frequency (RF) transceiver, and the illumination apparatus comprises a LED lamp, a light bulb, a fluorescent lamp, a street lamp, or an indicating lamp and further comprising a switch electrically coupled to the controller and the receiving/transmitting unit, wherein the lighting unit comprises an ampere-meter outputting the signal representative of the status of the lighting unit, wherein the monitoring circuit comprises an ampere monitor.

10. A monitoring and control method, applicable to an illumination apparatus comprising a monitoring circuit, a controller, a receiving/transmitting unit and a lighting unit which outputs a signal representative of a status of the lighting unit, the illumination apparatus comprising an apparatus identifier, the monitoring and control method comprising:

the monitoring circuit receiving the signal and determining whether the illumination apparatus needs to be replaced in response to the signal satisfying a condition; and the controller controlling the receiving/transmitting unit to transmit the apparatus identifier of the illumination apparatus to be replaced in response to the illumination apparatus being determined to be replaced, wherein the receiving/transmitting unit comprises a radio-frequency (RF) transceiver, and the illumination apparatus comprises a LED lamp, a light bulb, a fluorescent lamp, a street lamp, or an indicating lamp and wherein the illumination apparatus comprises a switch electrically coupled to the controller and the receiving/transmitting unit, wherein the lighting unit comprises an ampere-meter outputting the signal representative of the status of the lighting unit, wherein the monitoring circuit comprises an ampere monitor.

11. The monitoring and control method as claimed in claim 10, wherein the receiving/transmitting unit periodically transmits the apparatus identifier.

12. The monitoring and control method as claimed in claim 11, wherein the illumination apparatus is adapted for communicating with a communication unit, and the monitoring and control method further comprising:

the communication unit transmitting a control signal to the receiving/transmitting unit so that the receiving/transmitting unit stops transmitting the apparatus identifier in response to the communication unit receiving the apparatus identifier.

13. The monitoring and control method as claimed in claim 12, further comprising the communication unit transmitting the apparatus identifier to an information system in response to the communication unit receiving the apparatus identifier, wherein the information system comprises an information processing system managing the illumination apparatus, an information processing system managing other illumination apparatuses, or a central control information processing system.

14. The monitoring and control method as claimed in claim 10, further comprising determining whether the illumination apparatus functions properly before determining whether the illumination apparatus needs to be replaced.

15. The monitoring and control method as claimed in claim 10, wherein the condition comprises: an output of the ampere-meter is determined to be zero by the ampere monitor, wherein the controller controls the switch to turn on so that the receiving/transmitting unit transmits the apparatus identifier in response to the output of the ampere-meter being zero.

16. The monitoring and control method as claimed in claim 10, wherein the condition comprises: an output of the ampere-meter is determined to be lower than and/or equal to a certain proportion of an initial output value of the ampere-meter by the ampere monitor, wherein the controller controls the switch to turn on so that the receiving/transmitting unit transmits the apparatus identifier.

* * * * *